US007661670B2

(12) United States Patent
Shinohara

(10) Patent No.: US 7,661,670 B2
(45) Date of Patent: Feb. 16, 2010

(54) SHEET DISCHARGE DEVICE

(75) Inventor: Masaaki Shinohara, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 12/068,148

(22) Filed: Feb. 4, 2008

(65) Prior Publication Data

US 2008/0191410 A1 Aug. 14, 2008

(30) Foreign Application Priority Data

Feb. 8, 2007 (JP) ..... 2007-029431

(51) Int. Cl.
*B65H 31/00* (2006.01)

(52) U.S. Cl. ..... 271/209; 271/207; 271/213; 271/223

(58) Field of Classification Search ..... 271/209, 271/207, 213, 214, 220, 221, 223, 224, 262, 271/263, 265.04, 210
See application file for complete search history.

(56) References Cited

U.S. PATENT DOCUMENTS 3,802,699 A * 4/1974 Wiig et al ..... 271/202
4,667,949 A * 5/1987 Goodwin et al. ..... 271/207
5,076,558 A * 12/1991 Bergeron et al. ..... 271/3.05
5,451,044 A * 9/1995 Nakayama ..... 271/189
5,518,229 A * 5/1996 Tahara et al. ..... 271/180
5,709,382 A * 1/1998 Shima ..... 271/209
5,975,521 A * 11/1999 Ono et al. ..... 271/188
6,234,076 B1 * 5/2001 Mizutani et al. ..... 101/118
6,503,011 B2 * 1/2003 Kono ..... 400/646
6,581,928 B1 * 6/2003 Stephan ..... 271/188
6,701,841 B2 * 3/2004 Tsurumaki ..... 101/419
7,243,913 B2 * 7/2007 Terao et al. ..... 270/58.08
7,383,017 B2 * 6/2008 Ushio ..... 399/406

* cited by examiner

*Primary Examiner*—Patrick H Mackey
*Assistant Examiner*—Prasad V Gokhale
(74) *Attorney, Agent, or Firm*—Manabu Kanesaka

(57) ABSTRACT

A sheet discharge device neatly and uniformly aligns edges of print sheets irrespective of the thickness of a print sheet, and exerts the same effect even at a low discharge speed. The sheet discharge device includes: sheet information sensing means for detecting thickness of a print sheet to judge the sheet as a thick sheet, a regular sheet, or a thin sheet; conveying means for discharging the print sheet bearing a printed image in a predetermined direction; a discharge tray that accommodates a stack of the print sheets discharged by the conveying means; wings arranged at a tail end portion of the conveying means, coming in contact with two side edges in a widthwise direction of the print sheet so as to give a U shape curl by curving the sheet in a rough U shape during discharge; control means for commanding, based on the judgment by the sheet information sensing means, the wing to take a predetermined shift mode during discharge of the print sheet; and drive means for moving the wing in a shift mode designated by the control means.

4 Claims, 8 Drawing Sheets

(A-A CROSS SECTION)

SHEET DISCHARGE DEVICE

BACKGROUND OF THE INVENTION

1. Field of the Invention

The present invention relates in general to a printing apparatus, more specifically, to a sheet discharge device for discharging a print sheet toward a discharge tray.

2. Description of the Related Arts

In general, a printing apparatus has a sheet feed section to send out a top print sheet of a stack of paper loaded on a sheet feed tray, a printing section to carry out printing on the print sheet supplied from the sheet feed section, a sheet discharge device to discharge a print sheet, and a discharge tray to receive the print sheet discharged by the sheet discharge device.

Moreover, it takes some time for wet ink on the print sheet to dry. Therefore, when sheets of printing paper are printed successively, a print sheet being discharged now may brush a printed surface of a previously print sheet that is stacked on the top of the discharge tray, thereby smearing a printed image thereon.

Thus, in order to stack up print sheets on the discharge tray, it is desired to make a print sheet fall at right angles to the print sheet(s) on the discharge tray.

For instance, Japanese Unexamined Patent Application Publication No. 2001-240290 discloses a sheet discharge device includes a pair of flying induction members that function as jump wings for flying a print sheet having been carried by a conveyor belt (or transfer belt), while maintaining the print sheet in a bent form (roughly U shape).

In order to give a roughly U shape curl in the sheet, the flying induction member pair shift in the widthwise direction of the sheet according to information (size of the sheet) of a print sheet, and the two opposite faces come in contact with two side edges in the widthwise direction of the print sheet. Accordingly, a print sheet being discharged maintains a horizontal state with respect to a sheet transfer direction, and ends of the discharged sheets are aligned neatly.

However, the thickness of a print sheet is expressed in terms of weight per unit area ($g/m^2$). For example, a print sheet is described as 'regular' if the thickness falls within the range of 58 $g/m^2$ to 105 $g/m^2$, 'thick' if the thickness is greater than the range, and 'thin' if the thickness is less than the range. A typical sheet discharge device determines the distance between sheet discharge wings (flying induction members) corresponding to a regular print sheet of various sizes.

What happens in the case of discharging a thick print sheet more elastic than a regular sheet is that, when an attempt is made to give a rough U shape curl to the print sheet (thick sheet), the repulsive elasticity of the thick sheet wins over a nip force (the dead weight of a sheet discharge roller, or its dead weight+spring pressure) and a suction force of a suction section maintaining a print sheet on a conveyor belt, so the thick sheet is not curved in a roughly U shape but floats instead. As a result, the print sheet may not be conveyed. This problem occurs more easily as the repulsive elasticity of a sheet increases even more toward a bottom of the sheet in a cantilever state where the dead weight for pulling the sheet down is greater. If the nip force and the suction force are increased to keep a print sheet from floating, however, the sheet may be damaged during conveying, or problems like ink transfer contamination, a blurred looking image etc., may occur.

Therefore, when thick sheets are used for printing in a conventional printer, it is necessary to broaden the width of a sheet discharge wing (or lower the installation height of the sheet discharge wing) so as to give a small U shape curl to the sheet. However, because a sheet width during discharge increases correspondingly to a weak curl of a print sheet into the U shape, the width of a side fence of a V-shaped discharge tray shown in FIG. 2 has to be broadened greater than the width of loaded sheets. In consequence, a stack of loaded print sheets on the discharge tray may not be evenly arranged in the widthwise direction, thereby impairing alignment accuracy of sheet discharge.

In contrast, thin sheets are much less elastic than the regular sheet. Therefore, a conventional sheet discharge device sometimes fails to maintain a thin print sheet in a U shape during discharge, and the thin print sheet could sag downward from an exit port due to its dead weight. If the U shape curl of such print sheet is made in large scale to prevent any sagging of the print sheet, the width of a print sheet falling down onto the discharge tray becomes extremely narrower than the width defined by the side fences of the discharge tray. Hence, the print sheet cannot maintain its U shape and alignment of discharged sheets is not stable and uniform. Moreover, with a conventional sheet discharge device, a print sheet falling on the discharge tray comes in contact with the side fence thereof and the falling speed of the print sheet decreases by that. However, in the case of thin print sheets, no contact is made between the thin print sheets and the side fences of the discharge tray, so the falling speed of the sheets are not decreased. Rather, the thin print sheets may fly up while falling due to air resistance and jump over the end fence of the discharge tray.

Especially, the problems with thin sheets are more evident in ink jet printing or double-sided printing where a sheet discharge speed is set to lower than offset printing because print sheets at the exit port stay longer in the cantilever state.

SUMMARY OF THE INVENTION

In view of the foregoing problems, it is therefore an object of the present invention to provide a sheet discharge device capable of discharging a print sheet in an optimum shape corresponding to the thickness of the print sheet to neatly align edges of the discharged sheets, which is achieved irrespective of sheet thickness and even in inkjet printing with a relatively low discharge speed.

The above-mentioned object will be described with the accompanying drawings corresponding to the embodiment. According to a first aspect of the present invention, a sheet discharge device includes: sheet information sensing means for detecting thickness of a print sheet to judge the sheet as a thick sheet, a regular sheet, or a thin sheet; conveying means for discharging the print sheet bearing a printed image in a predetermined direction; a discharge tray that accommodates a stack of the print sheets discharged by the conveying means; wings arranged at a tail end portion of the conveying means, coming in contact with two side edges in a widthwise direction of the print sheet so as to curve the sheet in a rough U shape during discharge; control means for commanding, based on the judgment by the sheet information sensing means, the wing to take a predetermined shift mode during discharge of the print sheet; and drive means for moving the wing in a shift mode designated by the control means.

According to a second aspect of the present invention, if the print sheet is judged as a thick sheet by the sheet information sensing means, the control means controls the drive means to enter a shift mode for broadening the print sheet curved in a rough U shape in the widthwise direction, concurrently with passage of the print sheet at the wing.

According to a third aspect of the present invention, if the print sheet is judged as a thin sheet by the sheet information sensing means, the control means controls the drive means to enter a shift mode for narrowing the print sheet curved in a rough U shape in the widthwise direction, concurrently with passage of the print sheet at the wing.

DETAILED DESCRIPTION OF THE PREFERRED EMBODIMENT

Figure 1:
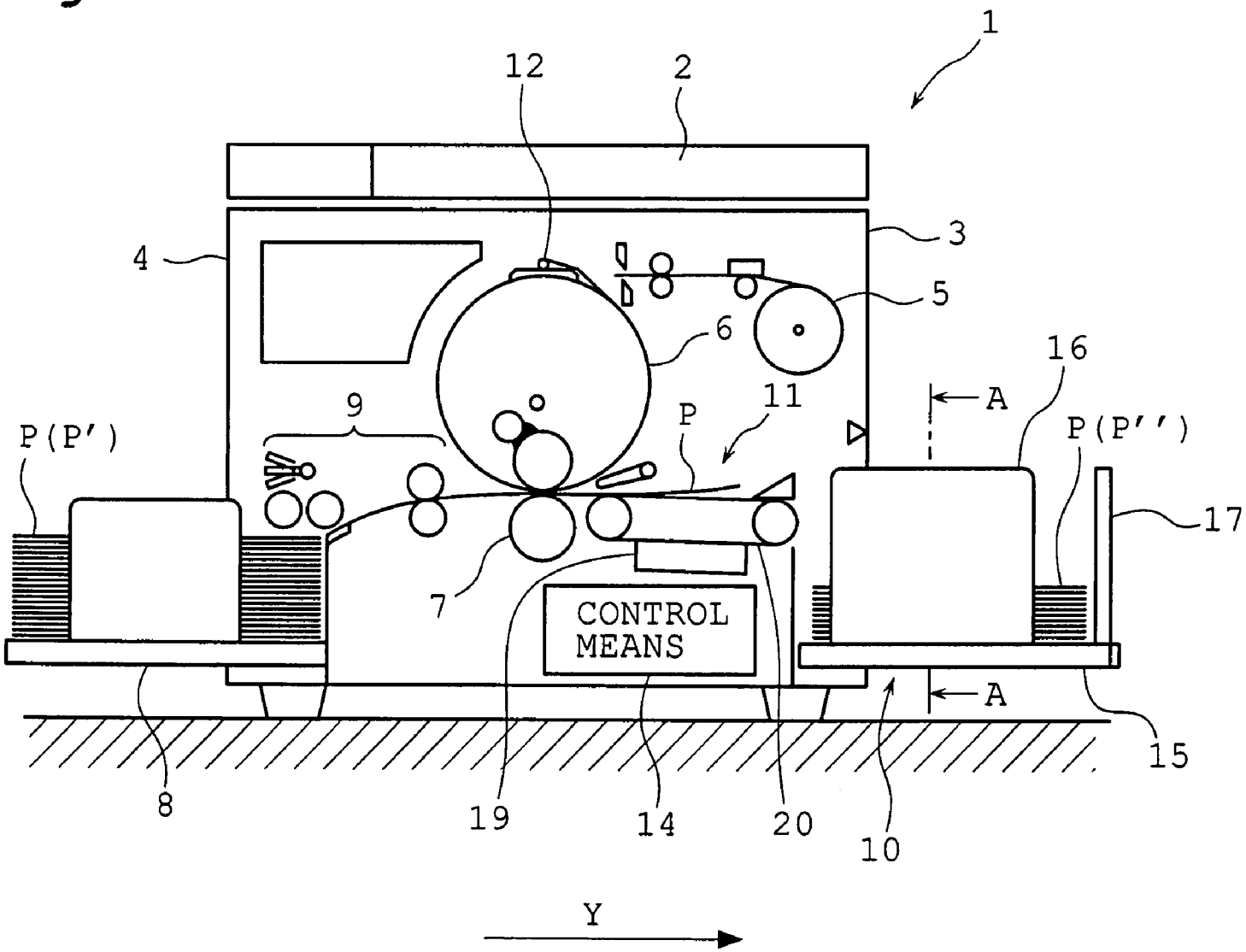
FIG. 1 is an explanatory diagram showing the entire configuration of a stencil printing apparatus to which a sheet discharge device according to a preferred embodiment of the present invention is applied.

A preferred embodiment of the present invention will now be described with reference to the accompanying drawings. FIG. 1 is an explanatory diagram showing the entire configuration of a stencil printing apparatus to which a preferred embodiment of the present invention is applied, FIG. 2 is a cross-sectional view taken along line A-A in FIG. 1, FIG. 3 is a plan view of a sheet discharge mechanism, FIG. 4 is a B-B arrow view of FIG. 3 (excluding the moving mechanism of a wing), and FIG. 5 is a block diagram of control means.

As shown in FIG. 1, a stencil printing apparatus 1 includes a housing (or casing) 4 where a manuscript tray 3 whose upper face is covered with a manuscript tray cover 2 is installed; a printing drum 6 which is rotatably installed in the housing 4 and holds a stencil sheet 5 on its surface to supply ink from its inside to the stencil sheet 5; a press roller 7 installed opposedly to a printing surface of the printing drum 6; a sheet feed tray 8 installed at one side of the housing 4; a feed roller 9 which takes out print sheets P' from the sheet feed tray 8 one by one toward the printing drum 6 to convey the print sheet P' between the printing drum 6 and the press roller 7 one after another; a sheet discharge mechanism 11 which discharges a print sheet P" toward a discharge tray 10 installed at the other side of the housing 4; an optical read-out section (not shown) which optically reads out a manuscript set on the manuscript tray 3; a thermal transfer mechanism (not shown) which engraves image information from the data having been read out by the optical read-out section to a stencil sheet 5; a clamp mechanism 12 which cuts the stencil sheet 5 into a proper size and adheres it onto the surface of the printing drum 6; an operator panel (not shown) installed outside the housing 4; and a control means 14 for controlling each component.

Figure 2:
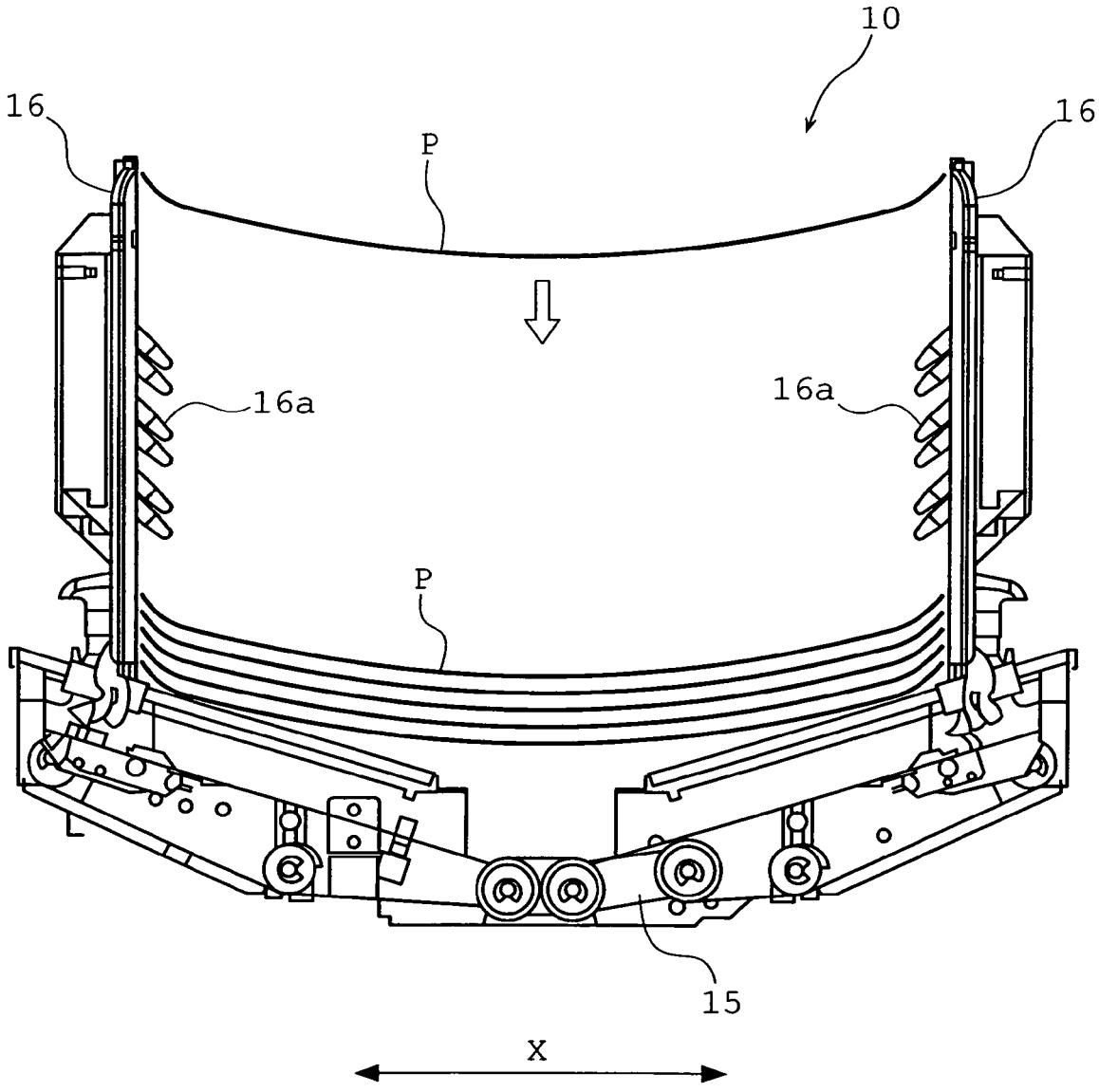
FIG. 2 is a cross-sectional view taken along line A-A in FIG. 1.

As shown in FIGS. 1 and 2, the discharge tray 10 is roughly constituted of a bed plate 15, a pair of side fences 16 mounted opposedly on the bed plate 15 in the widthwise (X) direction, and an end fence 17 erecting on a front stage side of a sheet transfer direction (Y) on the bed plate 15. As the cross-sectional view of FIG. 2 illustrates, the bed plate 15 in this embodiment is formed in a rough shallow V-shape, seen from the sheet transfer direction (Y). In addition, the side fences 16 are slidably installed along the widthwise (X) direction, and each one of the side fences 16 has on its inner wall face plural guide bars 16*a* being downwardly convex with respect to a flying direction of the print sheet P, thereby keeping the print sheet P from flying up or lifting off. Therefore, print sheets P falling into the discharge tray 10 are stacked and layered on the bed plate 15, while still formed in a rough U shape.

Figure 3:
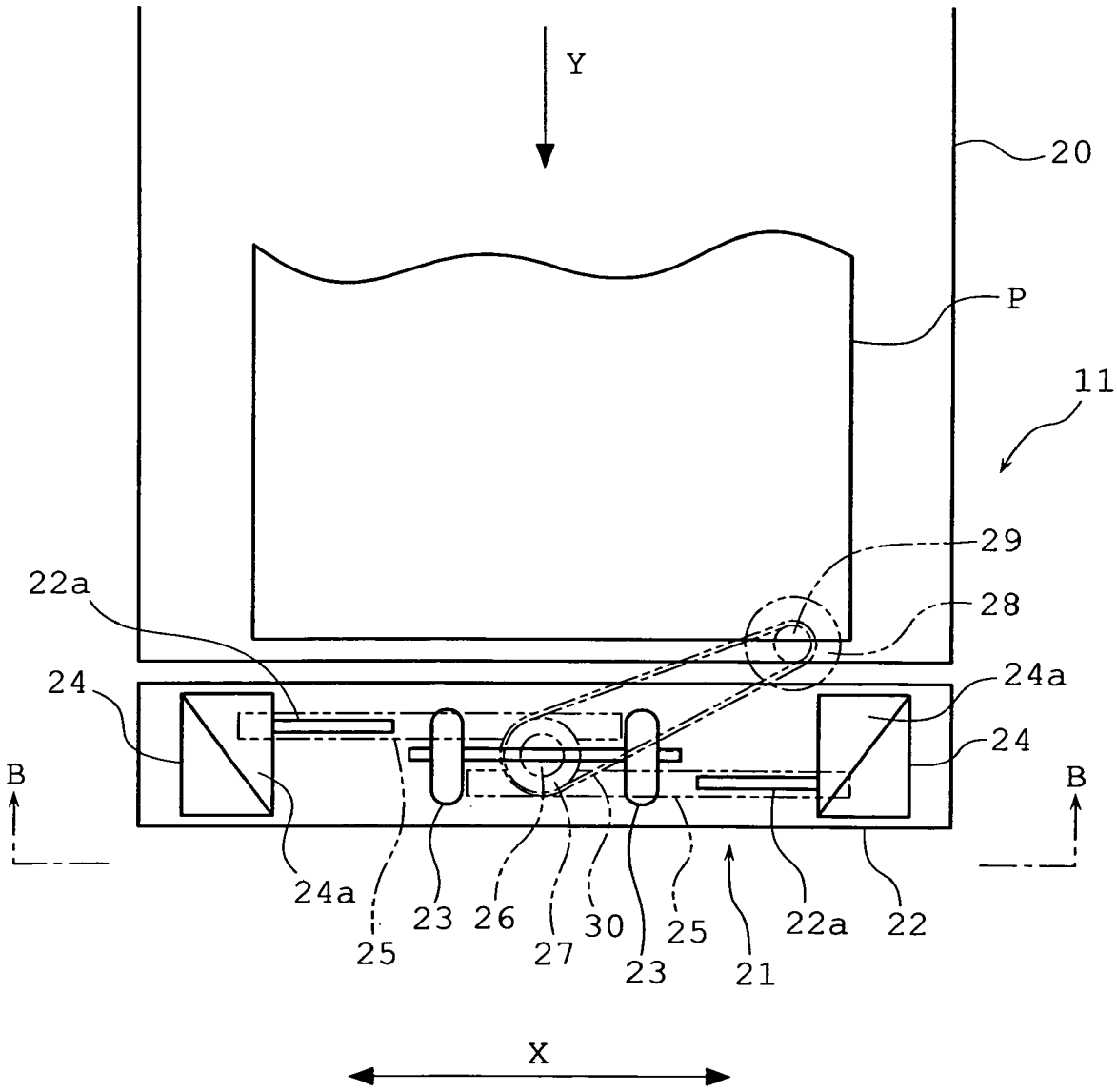
FIG. 3 is a plan view of a sheet discharge mechanism of the sheet discharge device shown in FIG. 1.
Figure 4:
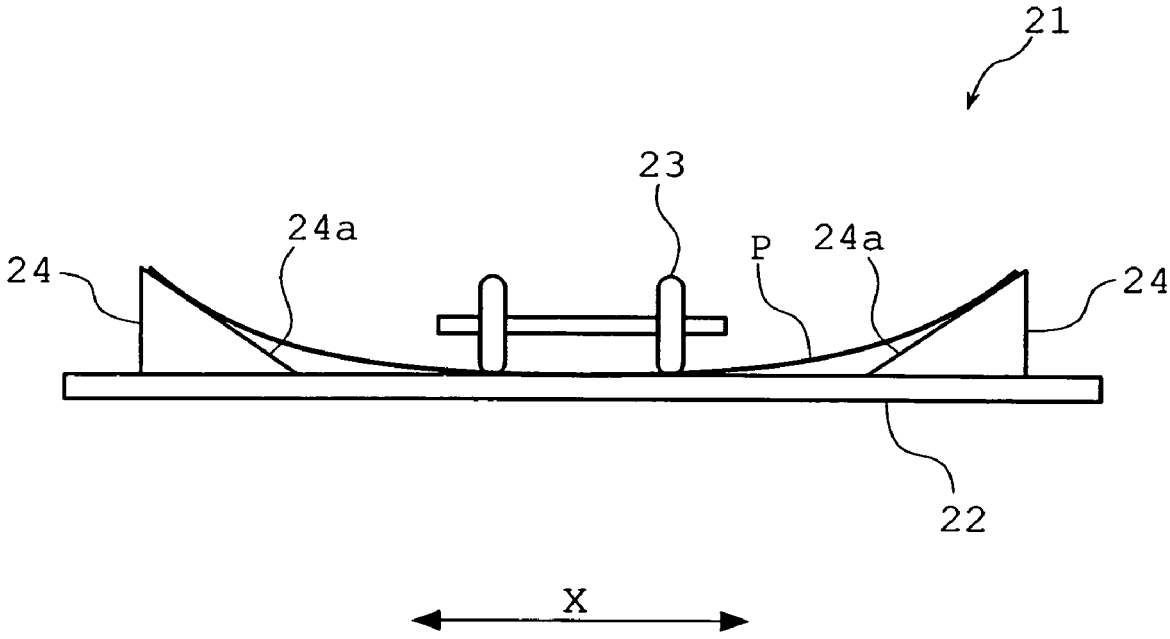
FIG. 4 is a B-B arrow view of FIG. 3.
Figure 5:
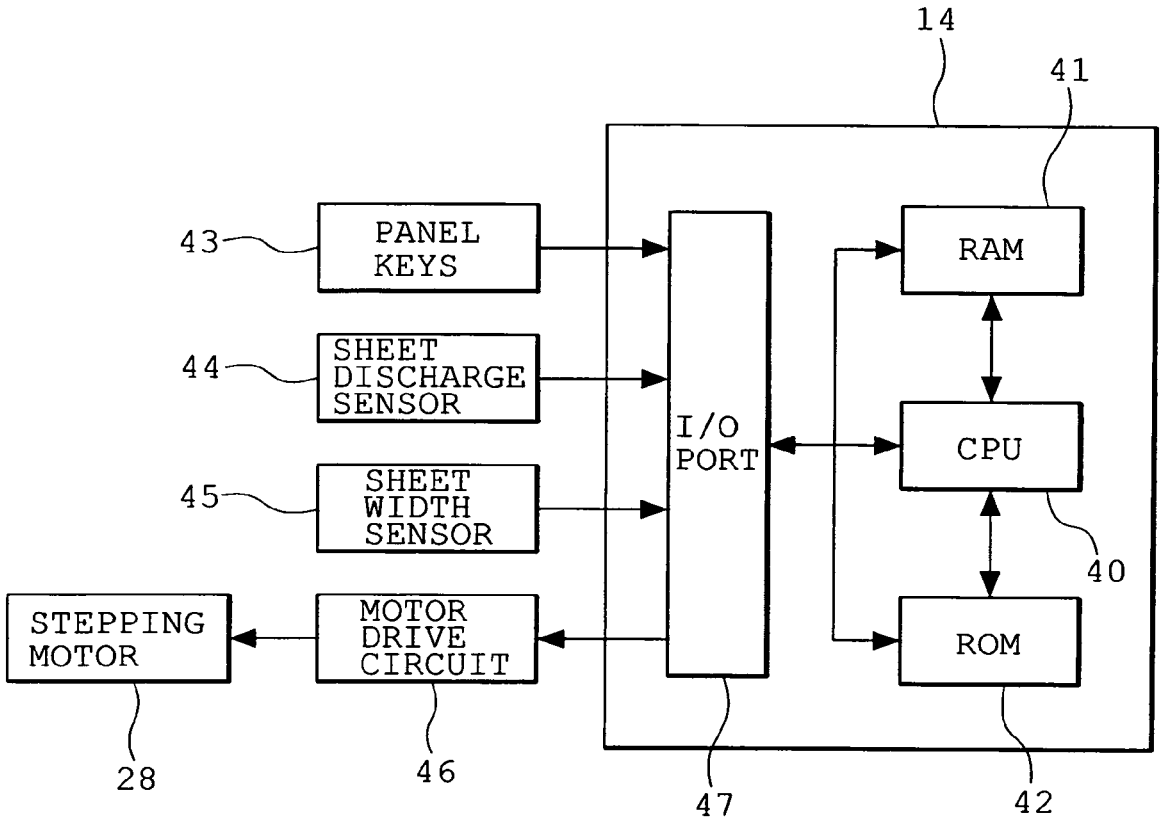
FIG. 5 is a block diagram of means in the sheet discharge device shown in FIG. 1.

Referring to FIGS. 1, 3, and 4, the sheet discharge mechanism 11 is roughly constituted of a conveyor belt 20 which conveys a print sheet P being fed or drawn out from between the printing drum 6 and the press roller 7 in the sheet transfer direction (Y); a suction section 19 which is disposed at the bottom of the conveyor belt 20 to adsorb a print sheet P onto the conveyor belt 20; and a sheet discharge unit 21 mounted at a tail end portion of the conveyor belt 20.

The sheet discharge unit 21 is roughly constituted of a table 22 disposed at an exit port, the tail end position of the conveyor belt 20; a pair of discharge rollers 23 disposed at roughly a middle portion of the widthwise (X) direction on the table 22; and a pair of discharge wings 24 which are slidably installed along guide slits 22*a* elongated in the widthwise (X) direction on both sides of the discharge rollers 23, respectively, and which are arranged opposedly to each other along the widthwise (X) direction.

The discharge wings 24, as shown in FIGS. 3 and 4, have opposed faces in the widthwise (X) direction that slope downwardly towards each other, and upwardly oblique guide faces 24*a* along the sheet transfer direction (Y), respectively, wherein each of the guide faces 24*a* comes in contact with the bottom face on both ends of a print sheet P in the widthwise (X) direction. When seen from the sheet transfer direction (Y), the print sheet P is curved and given in a roughly U shape curl. In general, the distance between a pair of discharge wings 24 is defined according to each size of a regular print sheet P.

With reference to FIG. 3, the following briefly explains about a mechanism for slide movement of the discharge wings 24.

As shown in FIG. 3, racks 25 are installed at the bottom of their corresponding guide slits 22*a*. Each of the racks 25 is held to be movable in the widthwise (X) direction by a guide mechanism (not shown). Moreover, the racks 25 are connected to the discharge wings 24 via a connection member (not shown) which insertedly passed through the guide slits 22*a*. Also, each of the racks 25 is engaged with a pinion 26 so that the discharge wings 24 interoperate through their common pinion 26 and move along the widthwise(X) direction, moving relatively close to each other or apart from each other.

In addition, a pulley 27 is attached to a shaft of the pinion 26. Another pulley 29 is attached to a shaft of a stepping motor 28 functioning as drive means. These two pulleys 27 and 29 are connected with a belt 30. Hence, if the stepping motor 28 starts operating, the pinion 26 rotates to move the discharge wings 24.

Although this embodiment introduced a configuration to obtain a rotating-linear movement by the racks 25 and the pinion 26, other mechanisms such as links may also be used. Needless to say, other mechanisms may also be employed for the rotation transfer mechanism constituted of pulleys 27 and 29 and a belt 30.

Further, the discharge roller 23 presses a print sheet P by applying its dead weight or its dead weight plus a spring pressure.

Besides, a sheet discharge sensor 44 (refer to FIG. 5) is mounted on the tail end portion of the conveyor belt 20 in order to monitor the discharge state of a print sheet P and as a part of sheet information sensing means.

The sheet discharge sensor 44 as the sheet information sensing means in FIG. 5 is provided with a light transmitting element and a light receiving element, so that it may detect the thickness of a print sheet P based on the transmission amount of X-rays irradiated from the light transmitting elements arrayed on the top of the tail end portion of the conveyor belt 20 and judge the type of the corresponding sheet P as a thick, regular, or thin sheet. The judgment result of the sheet discharge sensor 44 is outputted to the control means 14 as a detection signal. Based on this detection signal and contents (or commands) input by a user through the operator panel, the control means 14 controls an operation of the stepping motor 28.

As depicted in FIG. 5, the control means 14 includes a CPU 40, a RAM 41, and a ROM 42, and connected, through an I/O port 47, to all kinds of panel keys 43 having plural input keys on the operator panel, e.g., 'copies' to set up the number of copies and a start key to start a printing operation, the sheet discharge sensor 44, a sheet width sensor 45 (this detects the size of both A- and B-series) composing the sheet information sensing means together with the sheet discharge sensor 44, and a motor drive circuit 46 of the stepping motor 28. The control means 14 controls each section of the printing apparatus 1 to repeat its operation in a given sequence until the preset number of copies is completely made after the start key among the panel keys 43 is pressed.

Figure 6:
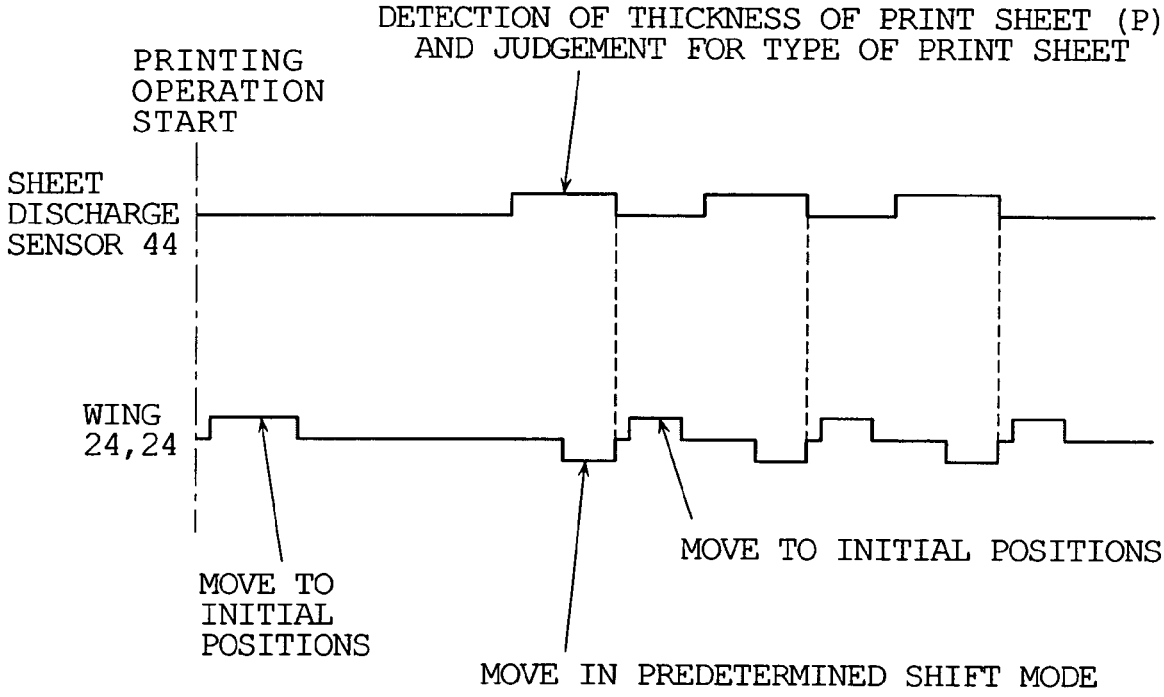
FIG. 6 is a time chart showing a relationship between a sheet discharge sensor and a wing in the sheet discharge device shown in FIG. 1.

FIG. 6 is a time chart showing the relationship between the sheet discharge sensor 44 and wings 24 among the constitutional elements of the printing apparatus. At the operation start point, the sheet discharge sensor 44 has not detected anything yet, but the wings 24 shift to their initial positions corresponding to the size of a print sheet P. And, after completion of printing, the print sheet P passes through the sheet discharge sensor 44 where the thickness of the print sheet P is detected and discriminated as thick, regular, or thin. Then, the wings 24 start moving in a predetermined shift mode corresponding to the detected thickness of the print sheet P. When discharge of the print sheet P is over, the wings 24 return to their initial positions and enter a standby state waiting for a next print sheet P to be conveyed.

With reference to FIGS. 7A, 7B, 8A and 8B, the following will now explain shift modes of the wings 24 depending on the thickness of a print sheet P.

Figure 7A:
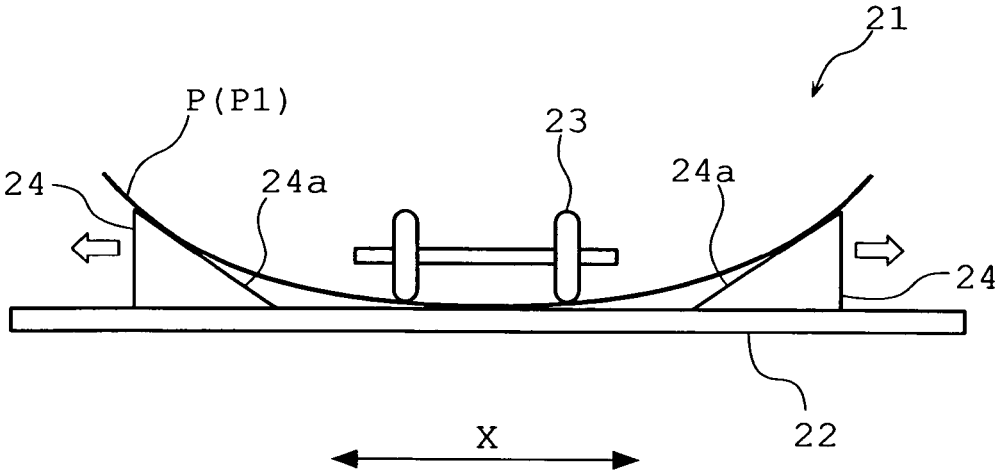
FIGS. 7A and 7B are explanatory diagrams showing the performance of a wing in the case of using a thick print sheet.
Figure 7B:
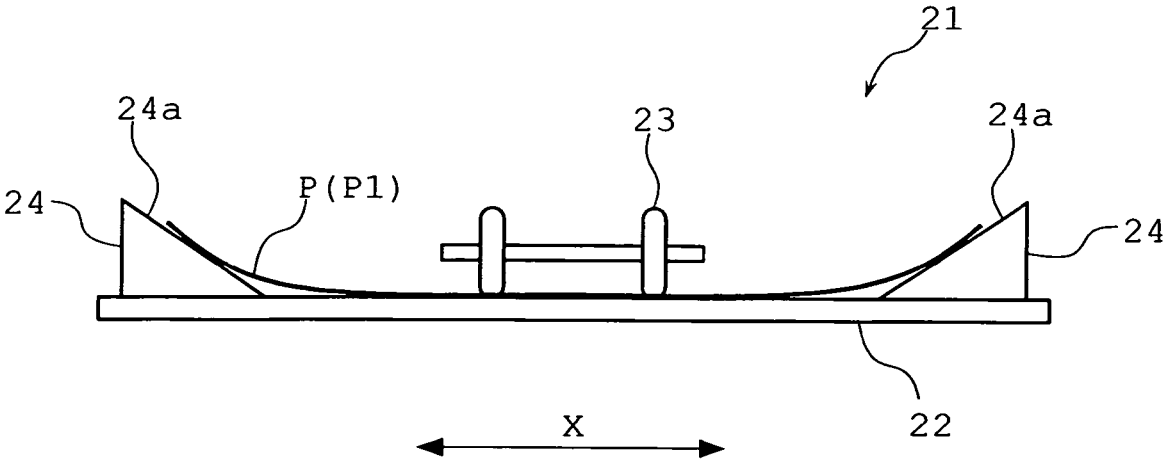

First, FIGS. 7A and 7B show the operations of the wings 24 in the case of a thick print sheet P. As depicted in FIG. 7A, if a thick print sheet P (P1) is used, the control means 14 (refer to FIG. 5) outputs a control signal to drive the stepping motor 28 (refer to FIG. 3) so that the wings 24 may shift to their initial positions coming in contact with both side edges in the direction of width (X) of the print sheet P1. Accordingly, the front end of the print sheet P1 in the sheet transfer direction (Y) is largely reformed into a U shape in an early discharge stage.

Next, as depicted in FIG. 7B, the control means 14 outputs again a control signal to drive the stepping motor 28 so that the wings 24 shift outward from each other in the widthwise (X) direction. As a result, the print sheet P1 spreads more toward the rear end of the sheet and the U shape curl slowly becomes weak and is eventually released. When the print sheet P1 fully passes through the sheet discharge unit 21, the control means 14 outputs yet another signal to drive the stepping motor 28 so that the wings 24 return to their initial positions and enter a standby state waiting for a next print sheet P1 to be conveyed.

Figure 8A:
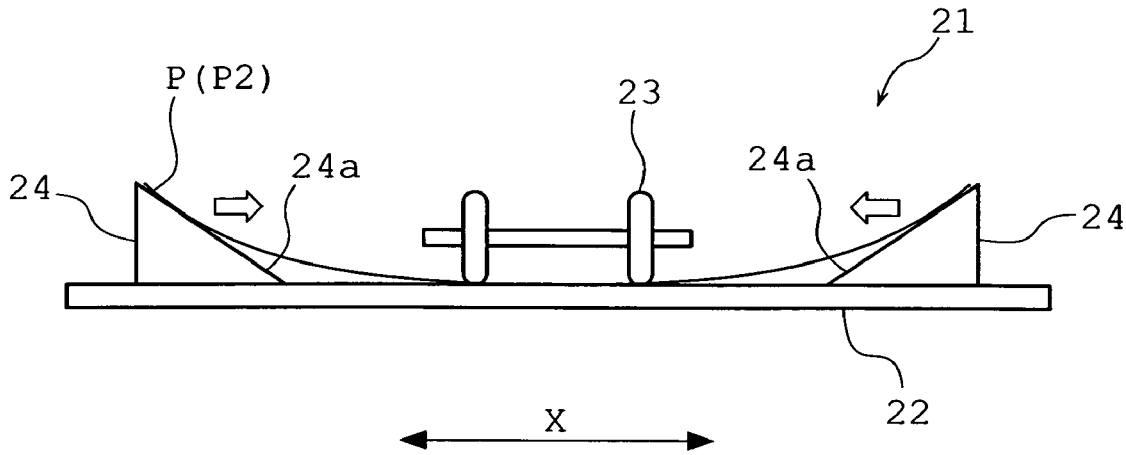
FIGS. 8A and 8B are explanatory diagrams showing the performance of a wing in the case of using a thin print sheet.
Figure 8B:
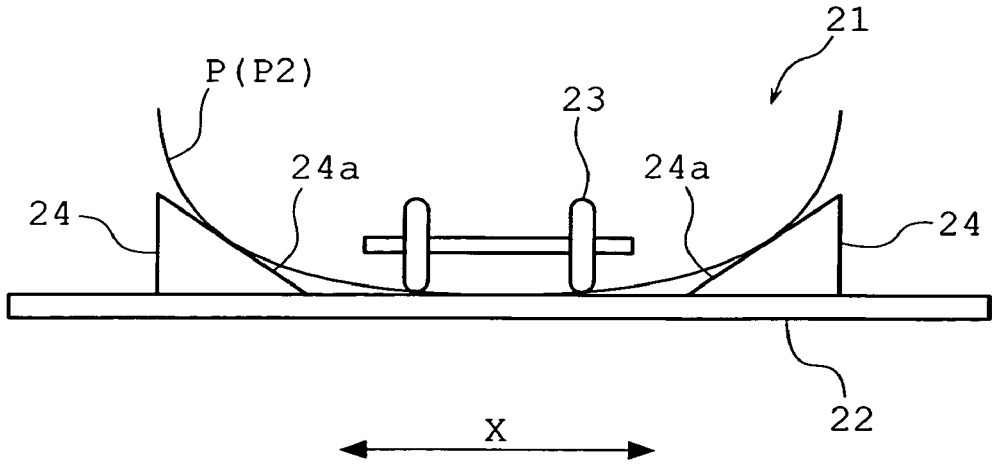

FIGS. 8A and 8B show the operations of the wings 24 in the case of a thin print sheet P. As depicted in FIG. 8A, if a thin print sheet P (P2) is used, the control means 14 outputs a control signal to drive the stepping motor 28 so that the wings 24 halt at their current positions (i.e., initial positions) being set according to the size of a regular sheet. Since the wings 24 are already at proper positions corresponding to the size of the print sheet P2 in response to an input command from the operator panel for example, they stop at the initial positions. Therefore, the front end of the print sheet P2 in the sheet transfer direction (Y) is given a U shape curl similarly to a regular sheet of the same size in an early discharge stage.

Next, as depicted in FIG. 8B, the control means 14 outputs another control signal to drive the stepping motor 28 so that the wings 24 shift inward toward each other in the widthwise (X) direction. As a result, contrary to the thick print sheet P1, the thin print sheet P2 becomes narrower toward the rear end of the sheet in the widthwise (X) direction and the U shape curl becomes gradually evident. And, when the print sheet P2 passes through the sheet discharge unit 21 completely, the control means 14 outputs yet another control signal to drive the stepping motor 28 so that the wings 24 may return to their initial positions and enter a standby state waiting for a next print sheet P2 to be conveyed.

Meanwhile, if a regular print sheet P is used, the control means 14 outputs a control signal to drive the stepping motor 28 so that the wings 24 remain at their initial positions. Accordingly, the print sheet P is given an even U shape curl.

According to the sheet discharge device of this embodiment, with the wings 24 in a predetermined proper shift mode corresponding to the thickness of the print sheet P, it becomes possible to maintain the sheet P in a rough U shape and obtain an optimal discharge state where ends of the discharged sheets are aligned neatly. For instance, if a thick print sheet P1 is used, the wings 24 shift inward toward each other along the widthwise (X) direction and the front end of the thick print sheet P1 is given a large U shape curl appropriately for the width defined by the side fences 16 of the discharge tray 10, the width being set smaller than the width of loaded sheets. Thereafter, as the wings 24 slowly shift outward away from each other in the widthwise (X) direction, the thick print sheet P1 spreads more toward its rear end and the U shape curl slowly becomes weak and is eventually released. In this way, the strong repulsive elasticity of the thick print sheet P1 is suppressed to prevent a problem like a non-transfer state.

On the other hand, if a thin print sheet P2 is used, the wings 24 are first controlled to stay at their current positions. As a result, the front end of the thin print sheet P2 is given a U shape curl similarly to a regular sheet of the same size, and the thin sheet P2 is discharged properly within the width of the side fences 16 of the discharge tray 10. Thereafter, as the wings 24 slowly shift inward toward each other in the widthwise (X) direction, the U shape curl of the thin print sheet P2 is reinforced toward the rear end of the sheet. In this way, the exterior strength of the sheet seen from the transfer direction (Y) is increased, thereby preventing the sheet from sagging downward from the exit port. Consequently, a uniform alignment of the discharged sheets can be accomplished even at a low discharge speed such as in an inkjet printing operation.

In this embodiment, the wings 24 slid in the widthwise (X) direction corresponding to the size of a print sheet P used, but they can also move vertically to give the print sheet P a rough U shape curl. That is, if a thick print sheet P1 is used, the wings 24 are first lifted up to come in contact with both end edges of the print sheet P1 in the widthwise(X) direction and then slowly descend, spreading or releasing the U shape curl of the print sheet P1.

Meanwhile, if a thin print sheet P2 is used, the wings 24 are elevated upward to give the thin print sheet P2 a U shape curl similarly to a regular sheet of the same size and go up further to reinforce the curl of the print sheet P2 into a U shape.

In this embodiment, although the sheet discharge sensor 44 was employed to detect the thickness of a print sheet P, the present invention is not limited thereto and may incorporate an edge sensor (a secondary sheet feed sensor in double-sided printing) or a top end sensor disposed at the front stage of a conveyor roller in the printing apparatus 1 to do the same, that is, detecting the thickness of a print sheet P. Further, the printing apparatus may include a sensor for detecting the floating degree of the sheet discharge roller 23 caused by the repulsive elasticity of a print sheet P so as to discriminate sheet thickness by judging whether the floating degree is above a reference one. Also, the thickness of a print sheet P may be input in the beginning through the operator panel.

In this embodiment, the size of a print sheet P is automatically detected by the sheet width sensor 45, but it may be input through the operator panel. It is also possible to use the aforementioned sensors in the printing apparatus 1 to detect sheet size based on the passing time of a print sheet P. Sensors arranged at the sheet feed tray 8 may detect sheet size as well.

As has been explained so far, the following advantages and effects can be obtained by the present invention.

The sheet discharge device according to the present invention makes it possible to keep a print sheet in a rough U shape by selectively setting the wings in a predetermined shift mode corresponding to the thickness of the print sheet during discharge. Therefore, the edges of discharged sheets can always be aligned in an optimal, neat state, irrespective of whether print sheets used are thick, regular or thin. As a result, a print sheet drops perpendicularly to the bottom face of the discharge tray and the print sheet is suppressed from being scattered on the discharge tray in the widthwise direction and the transfer direction of the sheet, thereby stacking neatly onto one another in a uniform manner. Moreover, even if there are already discharged print sheets on the discharge tray, the printed surface of a top sheet in a stack is no more damaged.

Especially, if a thick print sheet is used, the front end of a print sheet is first given a large U shape curl. In this way, the sheet width is not broadened but fittable within the width defined by side fences of the discharge tray, the width being set smaller than the width of loaded sheets. Thereafter, the thick print sheet spreads more toward its rear end and the U shape curl is slowly released. Hence, the strong repulsive elasticity of the thick print sheet is suppressed to prevent a problem like a non-transfer state.

Meanwhile, if a thin print sheet is used, the front end of a thin print sheet is given a U shape curl similarly to a regular sheet of the same size, and the thin sheet is discharged properly within the width of the side fences of the discharge tray. Thereafter, the U shape curl of the thin print sheet is reinforced toward the rear end of the sheet. In this way, the exterior strength of the sheet seen from the transfer direction is increased, and the sheet is prevented from sagging downward from the exit port, while creating a stable U shape during falling. Consequently, a uniform alignment of the discharged sheets can be accomplished even at a low discharge speed such as in an inkjet printing operation.

What is claimed is:

1. A sheet discharge device, comprising:

sheet information sensing means for detecting thickness of a print sheet to judge the sheet as a thick sheet, a regular sheet, or a thin sheet;

conveying means for discharging the print sheet bearing a printed image in a predetermined direction;

a discharge tray that accommodates a stack of the print sheets discharged by the conveying means;

wings arranged at a tail end portion of the conveying means, and contacting with two side edges in a widthwise direction of the print sheet so as to curve the sheet in a U shape during discharge;

control means for commanding, based on judgment by the sheet information sensing means, the wing to take a predetermined shift mode during discharge of the print sheet; and drive means for moving the wing in a shift mode designated by the control means, wherein when the sheet information sensing means judges the sheet as the regular sheet, the control means controls the drive means so that the wings remain at predetermined initial positions, when the sheet information sensing means judges the sheet as the thick sheet, the control means controls the drive means to enter a first shift mode for broadening the print sheet curved in the U shape in the widthwise direction by moving the wings from the initial positions toward the two side edges in the widthwise direction, concurrently with passage of the print sheet at the wings, and when the sheet information sensing means judges the sheet as the thin sheet, the control means controls the drive means to enter a second shift mode for narrowing the print sheet curved in the U shape in the widthwise direction by moving the wings from the initial positions toward each other in the widthwise direction, concurrently with passage of the print sheet at the wing.

2. The discharge device according to claim 1, wherein said conveying means includes a table, from which the wings project upwardly, and a discharge roller disposed between the wings to push a middle of the print sheet onto the table.

3. The discharge device according to claim 2, wherein said conveying means further includes guide slits provided in the table and extending in the widthwise direction, and racks connected to the wings for moving the wings along the guide slits.

4. The discharge device according to claim 1, wherein the control means controls the drive means so that the wings return to the predetermined initial positions after a trailing edge of the sheet completely passes the wings.

* * * * *